US011473834B2

(12) United States Patent
Park et al.

(10) Patent No.: US 11,473,834 B2
(45) Date of Patent: Oct. 18, 2022

(54) REFRIGERATOR

(71) Applicant: LG Electronics Inc., Seoul (KR)

(72) Inventors: Kihyun Park, Seoul (KR); Daehyun Yoo, Seoul (KR); Kiyoung Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 65 days.

(21) Appl. No.: 16/976,318

(22) PCT Filed: Mar. 8, 2019

(86) PCT No.: PCT/KR2019/002767
§ 371 (c)(1),
(2) Date: Aug. 27, 2020

(87) PCT Pub. No.: WO2019/177315
PCT Pub. Date: Sep. 19, 2019

(65) Prior Publication Data

US 2021/0048240 A1 Feb. 18, 2021

(30) Foreign Application Priority Data

Mar. 13, 2018 (KR) ..... 10-2018-0029194

(51) Int. Cl.
*F25D 23/06* (2006.01)
*F25D 23/02* (2006.01)
*F25D 27/00* (2006.01)

(52) U.S. Cl.
CPC ..... *F25D 23/063* (2013.01); *F25D 23/028* (2013.01); *F25D 27/00* (2013.01)

(58) Field of Classification Search
CPC ..... F25D 23/063; F25D 23/028; F25D 27/00; F25D 11/00; F25D 2327/001;
(Continued)

(56) References Cited

U.S. PATENT DOCUMENTS 3,079,770 A 3/1963 Brown
5,117,523 A 6/1992 Jacobus et al.
(Continued)

FOREIGN PATENT DOCUMENTS

CN 1727821 2/2006
CN 107250699 10/2017
(Continued)

OTHER PUBLICATIONS

Office Action in Chinese Appln. No. 201980006410.8, dated May 8, 2021, 17 pages (with English translation).
(Continued)

*Primary Examiner* — Hanh V Tran
(74) *Attorney, Agent, or Firm* — Fish & Richardson P.C.

(57) ABSTRACT

A refrigerator of the present disclosure includes an inner case configured to have a storage chamber, a door configured to open and close the storage chamber, a plurality of side panels configured to cover both sides of the inner case, the plurality of side panels being configured to be formed of a metal material, a case supporter configured to support the inner case, a base configured to support a lower side of the case supporter, at least a portion of the base being configured to be spaced apart from a lower side of the door and the case supporter, and a base panel configured to be attached to an upper surface of the base adjacent to the door, the base panel being configured to be formed of the same material as that of the plurality of side panels or having a metal texture.

20 Claims, 16 Drawing Sheets

(58) Field of Classification Search
CPC ..... F25D 2400/12; F25D 2700/04; F25D 23/003; F25D 2400/18; F25D 23/065; F25D 23/06
See application file for complete search history.

(56) References Cited

U.S. PATENT DOCUMENTS

| | | | | |
|---|---|---|---|---|
| 8,266,923 | B2 | 9/2012 | Bauer et al. | |
| 8,424,316 | B2 | 4/2013 | Tuszkiewicz et al. | |
| 10,429,032 | B2 * | 10/2019 | Choi | F21V 7/0008 |
| 10,557,663 | B2 * | 2/2020 | Park | A47B 96/16 |
| 10,775,100 | B2 * | 9/2020 | Signorino | F25D 23/065 |
| 10,808,994 | B2 * | 10/2020 | Lee | G02B 6/0093 |
| 10,859,294 | B2 * | 12/2020 | Kim | F25B 21/02 |
| 10,928,018 | B2 * | 2/2021 | Signorino | F21S 8/03 |
| 11,105,550 | B2 * | 8/2021 | Kim | F25D 13/00 |
| 11,156,395 | B2 * | 10/2021 | Oh | F25D 23/10 |
| 2003/0005716 | A1 | 1/2003 | Doran | |
| 2006/0218958 | A1 * | 10/2006 | Rand | F25D 23/021 62/302 |
| 2007/0241645 | A1 | 10/2007 | Trulaske | |
| 2007/0271954 | A1 | 11/2007 | Bauer et al. | |
| 2009/0296383 | A1 * | 12/2009 | Valster | F21V 7/0008 362/231 |
| 2010/0115969 | A1 | 5/2010 | Tuszkiewicz | |
| 2011/0146336 | A1 * | 6/2011 | Selin | F25D 23/063 62/449 |
| 2013/0134846 | A1 | 5/2013 | Büsing et al. | |
| 2013/0327064 | A1 | 12/2013 | Stein | |
| 2014/0111118 | A1 | 4/2014 | Kendall et al. | |
| 2014/0345316 | A1 * | 11/2014 | Godbole | A47F 5/0043 62/441 |
| 2015/0000314 | A1 * | 1/2015 | O'Connor | F25D 23/068 62/125 |
| 2016/0290713 | A1 * | 10/2016 | Twiggar, III | E05D 7/00 |
| 2018/0049548 | A1 * | 2/2018 | Lercher | A47B 91/005 |
| 2018/0274825 | A1 * | 9/2018 | Choi | F25D 11/00 |
| 2018/0320954 | A1 | 11/2018 | Wu | |
| 2019/0277555 | A1 * | 9/2019 | Yoo | F25D 23/006 |
| 2019/0280511 | A1 * | 9/2019 | Park | F25D 23/12 |
| 2019/0338941 | A1 * | 11/2019 | Signorino | F21V 13/04 |
| 2019/0339004 | A1 * | 11/2019 | Signorino | F21V 3/00 |
| 2020/0003462 | A1 * | 1/2020 | Sul | F25D 23/00 |
| 2020/0056827 | A1 * | 2/2020 | Oh | F25D 23/006 |
| 2020/0056828 | A1 * | 2/2020 | Kim | F25D 23/003 |
| 2020/0260668 | A1 * | 8/2020 | Choi | A01G 2/00 |
| 2021/0108850 | A1 * | 4/2021 | Yoo | F25D 21/08 |
| 2021/0140702 | A1 * | 5/2021 | Park | F25D 23/028 |
| 2021/0372692 | A1 * | 12/2021 | Park | F25D 23/10 |

FOREIGN PATENT DOCUMENTS

| | | | | |
|---|---|---|---|---|
| CN | 206817875 | | 12/2017 | |
| EP | 1972873 | | 9/2008 | |
| JP | 51067464 | | 5/1976 | |
| JP | 57040090 | | 3/1982 | |
| JP | 63175787 | | 11/1988 | |
| JP | H07218083 | | 8/1995 | |
| JP | 2003161565 | | 6/2003 | |
| JP | 2004194509 | A * | 7/2004 | |
| JP | 2005152523 | | 6/2005 | |
| JP | 2005180795 | | 7/2005 | |
| JP | 3863697 | B2 * | 12/2006 | |
| JP | 2006342996 | | 12/2006 | |
| JP | 2007292334 | | 11/2007 | |
| JP | 2017106637 | | 6/2017 | |
| JP | 2017106637 | A * | 6/2017 | F21V 5/10 |
| KR | 1020030063997 | | 7/2003 | |
| KR | 1020040009608 | | 1/2004 | |
| KR | 100448287 | | 9/2004 | |
| KR | 100480710 | | 4/2005 | |
| KR | 100727670 | | 6/2007 | |
| KR | 20090075010 | | 7/2009 | |
| KR | 101323876 | | 10/2013 | |
| KR | 20170019772 | | 2/2017 | |
| RU | 2371645 | | 10/2009 | |

OTHER PUBLICATIONS

Australian Examination Report in Australian Appln. No. 2019235973, dated Jan. 29, 2021, 6 pages.
Extended European Search Report in European Appln. No. 19767344.5, dated Sep. 14, 2021, 7 pages.
IN Office Action in Indian Appln. No. 202017005031, dated Nov. 26, 2020, 5 pages (with English translation).
Japanese Office Action in Japanese Appln. No. 2020-510599, dated Apr. 6, 2021, 11 pages (with English translation).
RU Office Action in Russian Appln. No. 2020133084/10, dated Dec. 24, 2020, 5 pages (with English translation).
Office Action in Korean Appln. No. 10-2018-0029194, dated Feb. 17, 2022, 10 pages (with English translation).
Notice of Allowance in Korean Appln. No. 10-2018-0029194, dated May 3, 2022, 4 pages (with English translation).

* cited by examiner

Fig. 16

| Mode | State display |
| --- | --- |
| Auto | (Blink 3-times operations) |
| Always ON | |
| OFF | |

REFRIGERATOR

CROSS-REFERENCE TO RELATED APPLICATIONS

This application is a National Stage application under 35 U.S.C. § 371 of International Application No. PCT/KR2019/002767, filed on Mar. 8, 2019, which claims the benefit of Korean Patent Application No. 10-2018-0029194, filed on Mar. 13, 2018. The disclosures of the prior applications are incorporated by reference in their entirety.

TECHNICAL FIELD

The present disclosure relates to a refrigerator.

BACKGROUND ART

Generally, a refrigerator is a household appliance that can store objects, such as food, in a low-temperature state in the storage chamber of a cabinet. Because the storage chamber is enclosed by an insulating wall, the interior of the storage chamber may be maintained at a temperature lower than the external temperature.

Depending on the temperature zone of the storage chamber, the storage chamber may be divided into a refrigerating chamber or freezing chamber. The user may store the food in the freezing room or the refrigerating room depending on the type and condition of the food.

The refrigerator may be provided in a built-in type together with other appliances in the kitchen. In this case, the appearance design of the refrigerator is configured to match the kitchen furniture.

In recent years, depending on the various needs of the user, the refrigerator is placed in a living room or a room, not a kitchen. In other words, the installation position of the refrigerator is various.

As the location of the refrigerator varies, the appearance of the refrigerator is configured so that the appearance of the refrigerator goes well with the furniture in the space to install the refrigerator.

Meanwhile, Korean Patent Publication No. 10-1323876 discloses a cooling packaging having a thermoelectric element and a refrigerator employing the same.

DISCLOSURE

Technical Problem

The present embodiment provides a refrigerator which may have aesthetic with an integrated outer appearance.

The present embodiment provides a refrigerator which can performs a illuminating function by irradiating light from an illumination unit on a heat dissipation flow path.

This embodiment provides a refrigerator in which foreign matters are prevented from flowing into a side of the heat dissipation flow path.

Technical Solution

A refrigerator according to an aspect of the present disclosure may include an inner case configured to have a storage chamber, a door configured to open and close the storage chamber, a plurality of side panels configured to cover both sides of the inner case, the plurality of side panels being configured to be formed of a metal material, a case supporter configured to support the inner case; a base configured to support a lower side of the case supporter, at least a portion of the base being configured to be spaced apart from a lower side of the door and the case supporter; and a base panel configured to be attached to an upper surface of the base, the base panel being configured to be formed of the same material as that of the plurality of side panels or having a metal texture.

The base panel may be spaced apart from a lower surface of the door and may be disposed to overlap the door in a vertical direction.

The refrigerator of claim may further include, a cooling device to cool the storage chamber and including a thermoelectric element, a cooling sink, and a heat sink.

A spaced space between the base and the case supporter may form a heat dissipation flow path for discharging the air which is heat-exchanged with the heat sink.

The heat dissipation flow path may be provided with a shielding member covering the heat dissipation flow path and including a plurality of holes through which air passes.

An outlet of the heat dissipation flow path may be formed between a lower surface of the door and the base. The shielding member may be disposed at a position spaced rearward from an outlet of the heat dissipation flow path.

The shielding member may include a shielding body including the plurality of holes, and a fixing portion extending from the shielding body. The base may be formed with a receiving portion in which the fixing portion is received.

The base panel may include a slot through which the fixing portion passes.

The shielding body may be provided with a fastening hole through which the fastening member for being fastened to the base supporter passes.

The refrigerator may further include a sensing unit configured to be installed in the case supporter, and an illumination unit configured to irradiate light to the heat dissipation flow path.

The sensing unit and the illumination unit may be located closer to the outlet of the heat dissipation flow path than the shield member.

The sensing unit may protrude from the case supporter onto the heat dissipation flow path, and the shielding member may be provided with an opening through which the sensing unit passes.

The case supporter may include an illumination unit installation portion for installing the illumination unit, and an inlet for installation of the illumination unit.

The inlet may be covered by a transmissive portion. The transmissive portion may be located closer to the outlet of the heat dissipation flow path than the sensing unit.

The transmissive portion may be spaced apart from the base panel and may be disposed to overlap the base panel in the vertical direction.

The illumination unit installation portion may includes an installation surface extending in the vertical direction, and a reflection surface extending to be inclined rearward from the upper end portion of the installation surface.

The illumination unit may include a PCB installed on the installation surface, and one or more light emitters installed on the PCB. The at least one light emitter may be disposed to face the reflective surface.

The sensing unit may be spaced apart from the base panel and may be disposed to overlap the base panel in the vertical direction.

The rear surface of the base may be provided with a handle configured to hold by a user, and the handle may be located in the rearmost of the refrigerator as a whole.

Advantageous Effect

According to the proposed disclosure, since, in a structure that the part forming the space is exposed to the outside, the part is formed of the same material as the panel forming an outer appearance of the refrigerator or covered by a panel having the same texture, there is an advantage that the refrigerator as a whole can have integrated aesthetic.

In addition, by irradiating light from the illumination unit on the heat dissipation flow path, there is an advantage that the refrigerator can perform the illuminating function.

In particular, since the portion to which light is irradiated has a metal texture or is formed of a metal material, the light is reflected and the user can easily check the light.

In addition, as the shielding member is provided in the heat dissipation flow path, air can pass through the heat dissipation flow path, and foreign matters having a predetermined size or more can be prevented from flowing into the heat dissipation flow path.

DESCRIPTION OF DRAWINGS

FIG. 16 is a view for explaining a method of operating a light emitting unit according to a selected illumination mode.

BEST MODE

Hereinafter, exemplary embodiments of the present disclosure will be described in detail with reference to the accompanying drawings.

Figure 1:
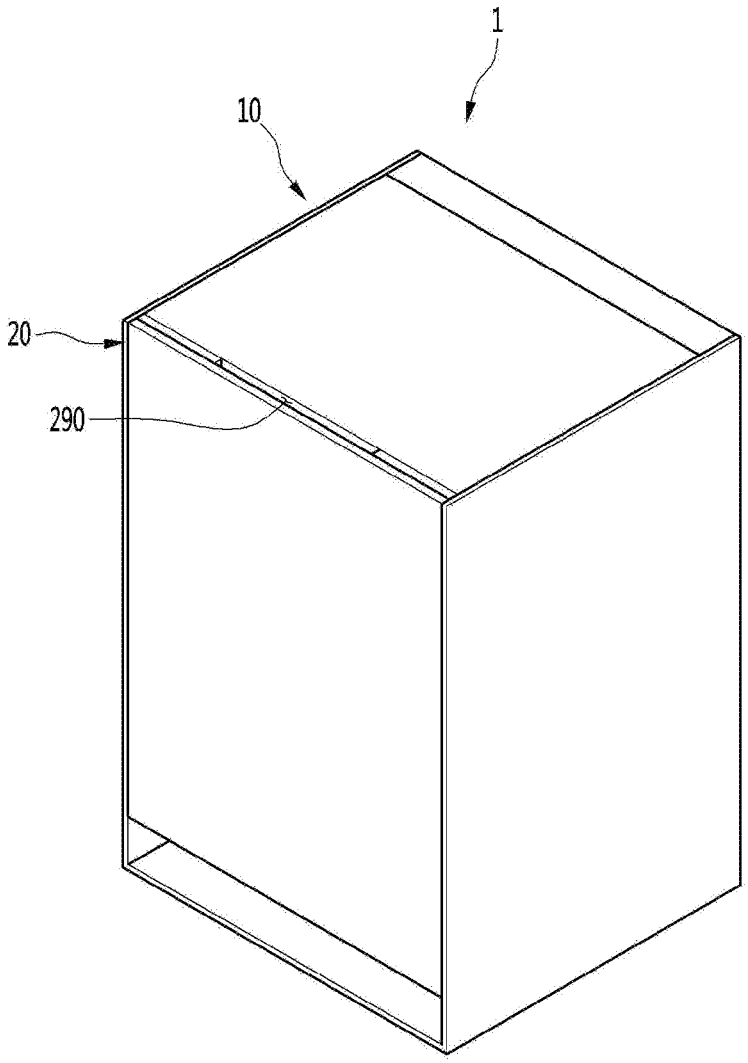
FIG. 1 is a perspective view of a refrigerator according to one embodiment of the present disclosure.
Figure 2:
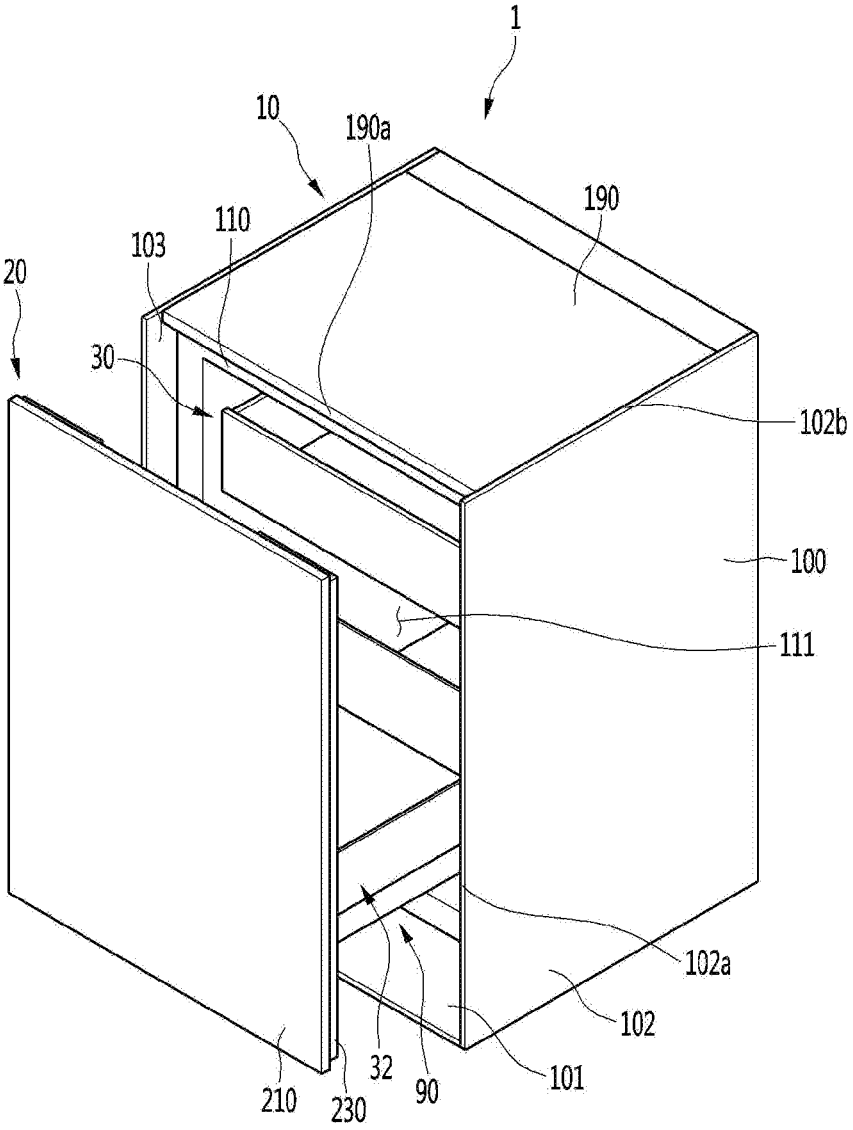
FIG. 2 is a perspective view illustrating a door being opened in FIG. 1.
Figure 3:
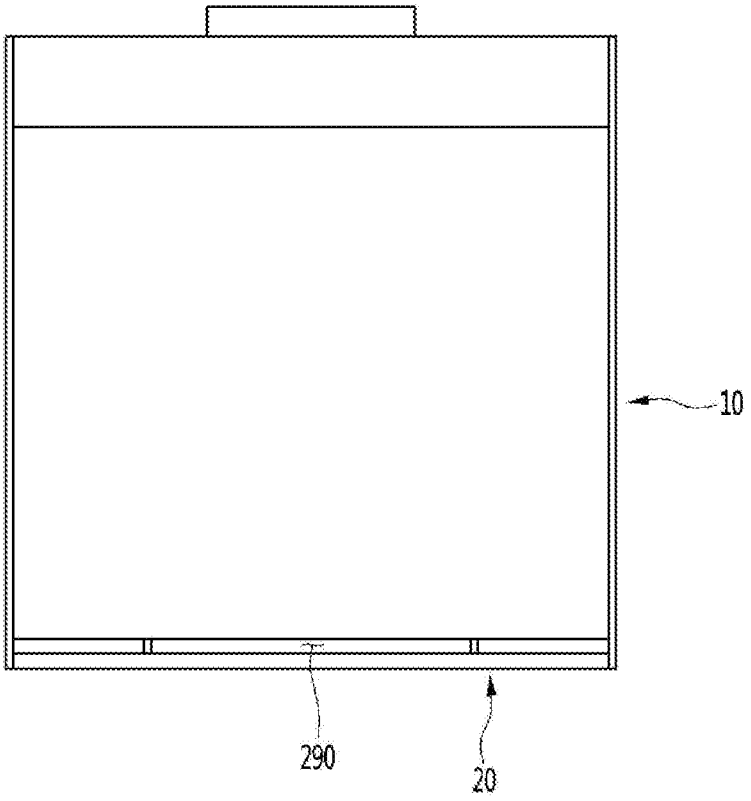
FIG. 3 is a plan view of the refrigerator of FIG. 1.

FIG. 1 is a perspective view of a refrigerator according to one embodiment of the present disclosure, FIG. 2 is a perspective view illustrating a door being opened in FIG. 1, and FIG. 3 is a plan view of the refrigerator of FIG. 1.

Referring to FIGS. 1 to 3, a refrigerator 1 according to one embodiment of the present disclosure may include a cabinet 10 having a storage chamber 111, a door 20, which opens and closes the storage chamber 111, and connected to the cabinet 10.

The cabinet 10 may include the inner casing 110 forming the storage chamber 111, and an outer casing 100 surrounding the inner casing 110.

The outer casing 100 may be formed of a metal material. For example, the outer casing 100 may be formed of aluminum Al.

The outer case 100 may be formed by bending or bending at least two times. Alternatively, the outer case 100 may be formed by joining a plurality of metal plates.

In one example, the outer casing 100 may include a pair of side panels 102 and 103.

The inner casing 110 may be directly or indirectly fixed to the outer casing 100 with the inner casing 110 being positioned between the pair of side panels 102 and 103.

A front end 102*a* of each of the pair of side panels 102 and 103 may be located more forwards than the front face of the inner casing 110.

The horizontal width of the door 20 may be equal to or less than the distance between the side panels 102 and 103.

Thus, a space in which the door 20 may be located may be defined between the pair of side panels 102 and 103.

In one example, the door 20 may be located between the pair of side panels 102 and 103 with the storage chamber 111 being closed by the door.

In this connection, the front face of the door 20 may be coplanar with a front end 102*a* of each of the side panels 102 and 103 such that a step between the door 20 and the cabinet 10 may not occur when the storage chamber 111 is closed by the door.

In other words, the front face of the door 20 and a front end 102*a* of each of the side panels 102 and 103 may together define the appearance of the front face of the refrigerator 1.

For example, the door 20 may be connected to the cabinet 10 by a rail assembly 90.

Accordingly, the door 20 may open and close the storage chamber 111 while moving in the front and rear sliding manner in a state of being connected to the cabinet 10.

According to this embodiment, even if the refrigerator 1 is placed in a narrow space such as a kitchen, a living room, or a room, since the door 20 opens and closes the storage chamber 111 in a sliding manner, there is an advantage that the door 20 can be opened without interference with surrounding structures.

The rail assembly 90 may have one side connected to the door 20 and the other side connected to the inner case 110.

The door 20 may include a front panel 210 made of wood and a door liner 230 coupled to a rear surface of the front panel 210.

In one example, the front panel 210 and the door liner 230 may be engaged with each other by fasteners such as screws.

The front panel 210 and the door liner 230 form a foam space therebetween. When the foam liquid is filled in the foam space, a thermal-insulating material may be formed between the front panel 210 and the door liner 230.

The door 20 may have a gripping space 290 in which a user's hand may be inserted so that the user can catch the door 20 to open the door 20.

In one example, the gripping space 290 may be formed by partially recessing an upper portion of the door liner 230 downwardly.

While the door 20 closes the storage chamber 111, the gripping space 290 may be located between the front panel 210 and the cabinet 10. Thus, while the door 20 closes the storage chamber 111, the user may open the door 20 by inserting a hand into the gripping space 290 and then pulling the door 20.

In the present embodiment, since while the door 20 is closed, a structure such as a handle does not protrude outward, there is an advantage that the beauty of refrigerator 1 is improved.

The height of the refrigerator 1 may be lower than a typical adult height. The present disclosure may not be limited thereto. The lower the capacity of the refrigerator 1, the lower the height of the refrigerator 1.

As in the present embodiment, when there is a gripping space 290 within the top of the door 20, the following advantage is achieved: Even though the height of the refrigerator 1 is low, the user can easily open the door 20 while the user is standing or sitting.

In one embodiment, the top end 102*b* of each of the pair of side panels 102 and 103 may be higher than the top of the inner casing 110.

Therefore, a space may be formed above the inner casing 110. A cabinet cover 190 may be located in the space. The cabinet cover 190 may form a top appearance of the cabinet 10. In other words, the cabinet cover 190 forms a top appearance of the refrigerator 1.

The cabinet cover 190 may be secured directly to the inner casing 110 or to the middle plate 150 surrounding the inner casing 110.

While the cabinet cover 190 covers the inner casing 110, the cabinet cover 190 may be located between the pair of side panels 102 and 103.

In one embodiment, in order to avoid a step between the cabinet cover 190 and the cabinet 10, a top surface of the cabinet cover 190 may be located on the same plane or the same height as the top end 102*b* of each of the side panels 102 and 103.

In one example, the cabinet cover 190 may be formed of wood material. The present disclosure is not so limited.

In the present embodiment, the front face panel 210 of the door 20 and the cabinet cover 190 are both formed of a wood material. Thus, there is an advantage that the aesthetics can be improved due to the material identity between the door 20 and the cabinet cover 190 while the door 20 is closed.

Further, when the height of the refrigerator 1 is low, the user can visually check the cabinet cover 190. In this connection, since the cabinet cover 190 is made of the wood material, this has the advantage of not only improving the basic aesthetics but also achieving aesthetic harmony with the surrounding furniture where the refrigerator 1 is positioned.

In one example, the refrigerator 1 of the present embodiment may be implemented as a refrigerator that can be used as a table (hereinafter, a table type refrigerator).

A refrigerator that can be used as a table may also serve as a table function in addition to the storage function of foods. Unlike conventional refrigerators, which are often found in the kitchen, a refrigerator, which can be used as a table, may be placed next to the bedroom bed and may be used.

In the present embodiment, since the cabinet cover 190 and the front face panel 210 are formed of wood material, the appearance of the refrigerator may be in harmony with the surrounding furniture when the refrigerator 1 is placed next to the bedroom.

In one example, for the convenience of the user, the height of the table type refrigerator is preferably similar to the height of the bed. The height of the table type refrigerator may be smaller than the height of a conventional refrigerator and thus the refrigerator may be formed compactly.

A front face 190*a* of the cabinet cover 190 may be located more forwards than the front face of the inner casing 110. Thus, while the door 20 closes the storage chamber 111, the cabinet cover 190 may cover a portion of the door liner 230 from above.

The refrigerator 1 may further include one or more drawer assemblies 30 and 32 received in the storage chamber 111.

A plurality of drawer assemblies 30 and 32 may be provided in the storage chamber 111 for efficient storage space.

Some of the plurality of drawer assemblies 30 and 32 may be provided in a state where the position thereof is fixed in the storage chamber or be disposed to be capable of being slid by the rail by being connected to the rail.

Alternatively, some of the plurality of drawer assemblies 30 and 32 may be connected to the door 20 to slide in and out together with the door 20.

Alternatively, some of the plurality of drawer assemblies 30 and 32 may be configured to slide out with the door 20 at the initial opening in the opening process of the door 20 and to stop at a position drawn out by the predetermined distance.

Hereinafter, the structure of the cabinet 10 will be described in detail.

Figure 4:
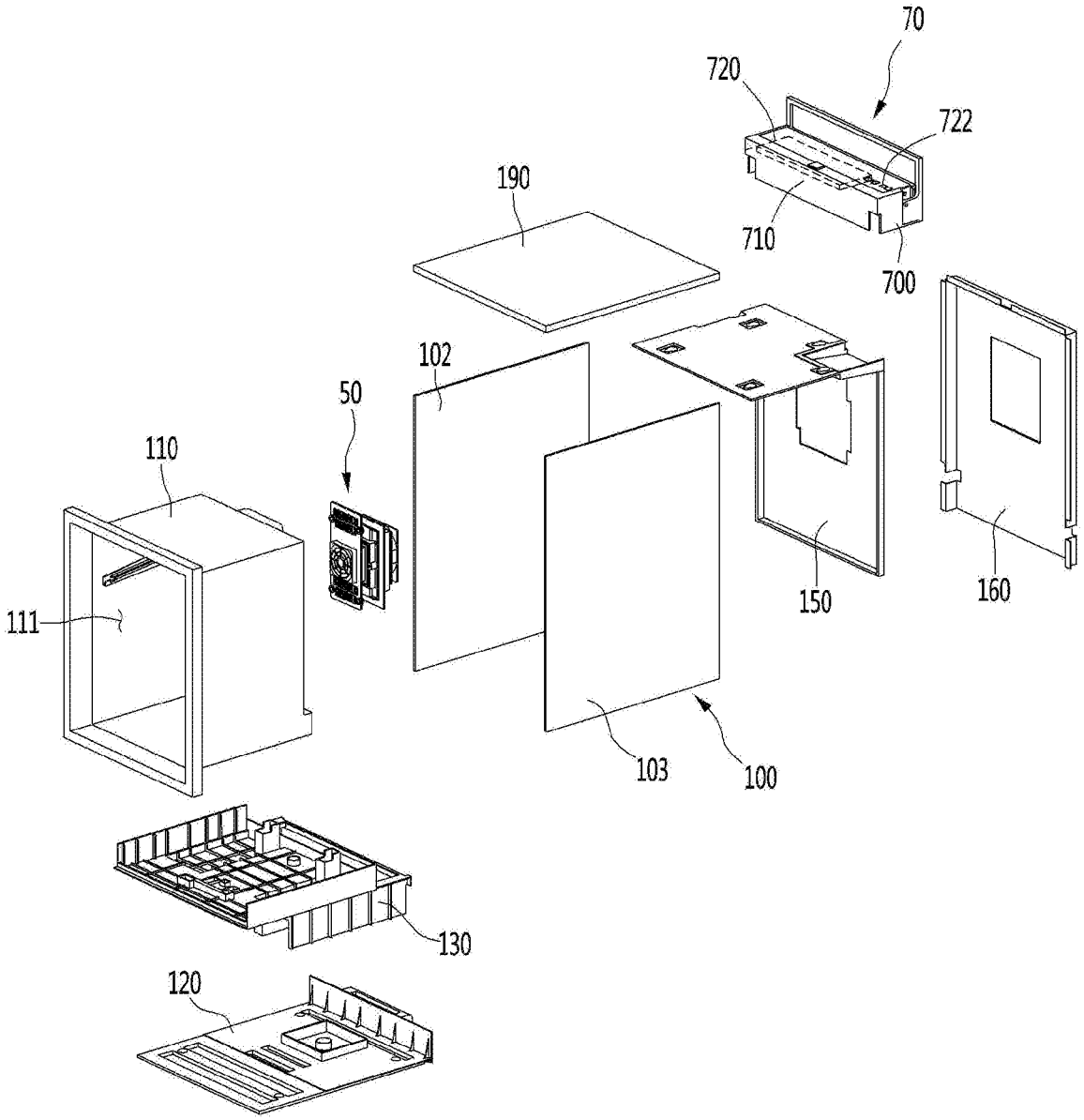
FIG. 4 is an exploded perspective view illuminating a cabinet according to an embodiment of the present disclosure.

FIG. 4 is an exploded perspective view of a cabinet according to one embodiment of the present disclosure.

Referring to FIGS. 1 to 4, a cabinet 10 according to one embodiment of the present disclosure may include an outer casing 100, an inner casing 110, and a cabinet cover 190.

The outer casing 100 may include a pair of side panels 102 and 103. The pair of side panels 102, 102 may form the side appearance of the refrigerator 1.

The outer casing 100 may further include a rear panel 160 that forms the rear surface appearance of the refrigerator 1.

Thus, the appearance of the refrigerator 1 except the door 20 may be formed by the side panels 102 and 103, the cabinet cover 190 and the rear panel 160.

The cabinet 10 may further include a casing supporter 130 supporting the inner casing 110 and a base 120 coupled to the bottom of the casing supporter 130.

Figure 8:
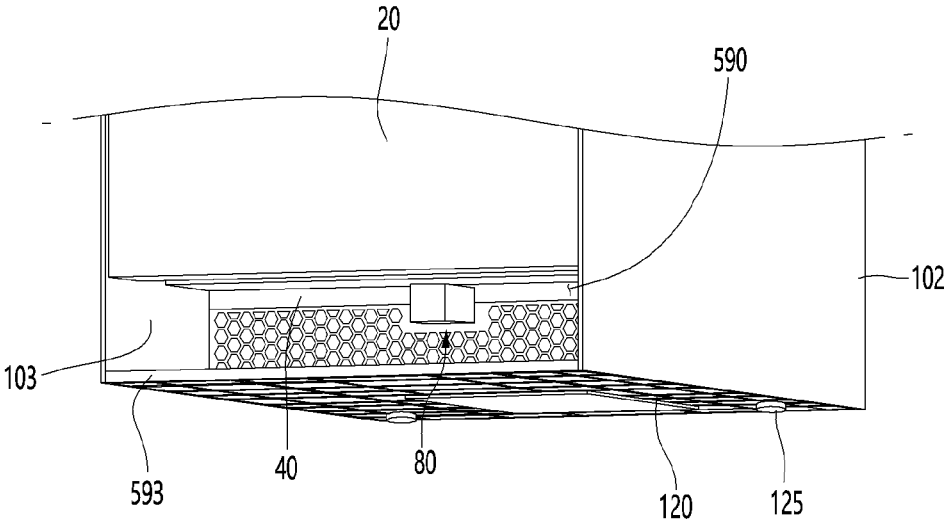
FIG. 8 is a view illustrating a state where a shield member is positioned in a heat dissipation path.

In a state where the base 120 is coupled to the case supporter 130, at least a portion of the case supporter 130 may be spaced apart from the base 120 to form a heat dissipation flow path 590 (FIG. 8).

The base 120 may be coupled to the side panels 102 and 103. For example, double-sided tape may be attached to both sides of the base 120, and double-sided tape may be attached to the side panels 102 and 103.

The base 120 may be screw-fastened to the case supporter 130 as an example, and the case supporter 130 may be screwed to the side panels 102 and 103 as an example.

The cabinet 10 may also include a middle plate 150. The middle plate, together with the inner casing 110, forms a foam space. The middle plate 150 may cover the top and rear surfaces of the inner casing 110 at a spaced apart position from the inner casing 110.

The cabinet 10 may further include a cooling device 50 for cooling the storage chamber 111.

The cooling device 50 may include a thermoelectric element. The thermoelectric element may maintain a low temperature of the storage chamber 111 by utilizing a Peltier effect. The cooling device 50 will be described later.

The refrigerator 1 may further include a display unit 70.

The display unit 70 may be located behind the cabinet cover 190.

The display unit 70 may include a display case 700, a display PCB 710 received in the display case 700, and a display unit 720 on which information is displayed.

The display unit 720 can display information and input a user's command. For example, the display PCB 710 may include a sensor and a light emitting unit, detect a command input using a sensor, and display information through the light emitting unit. Alternatively, the display unit 720 may be provided in the form of a touch screen to receive a user's touch command and display information on the screen.

One or more charging ports 722 to which a charging cable connected to the portable device is connected to charge the battery of the portable device may be provided on one side of the display unit 720.

Figure 5:
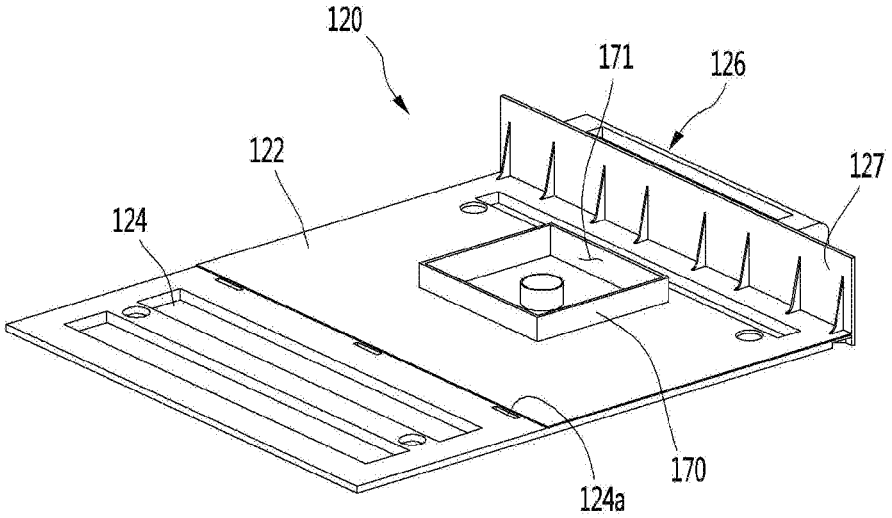
FIGS. 5 and 6 are a perspective view illuminating the base according to an embodiment of the present disclosure.
Figure 6:
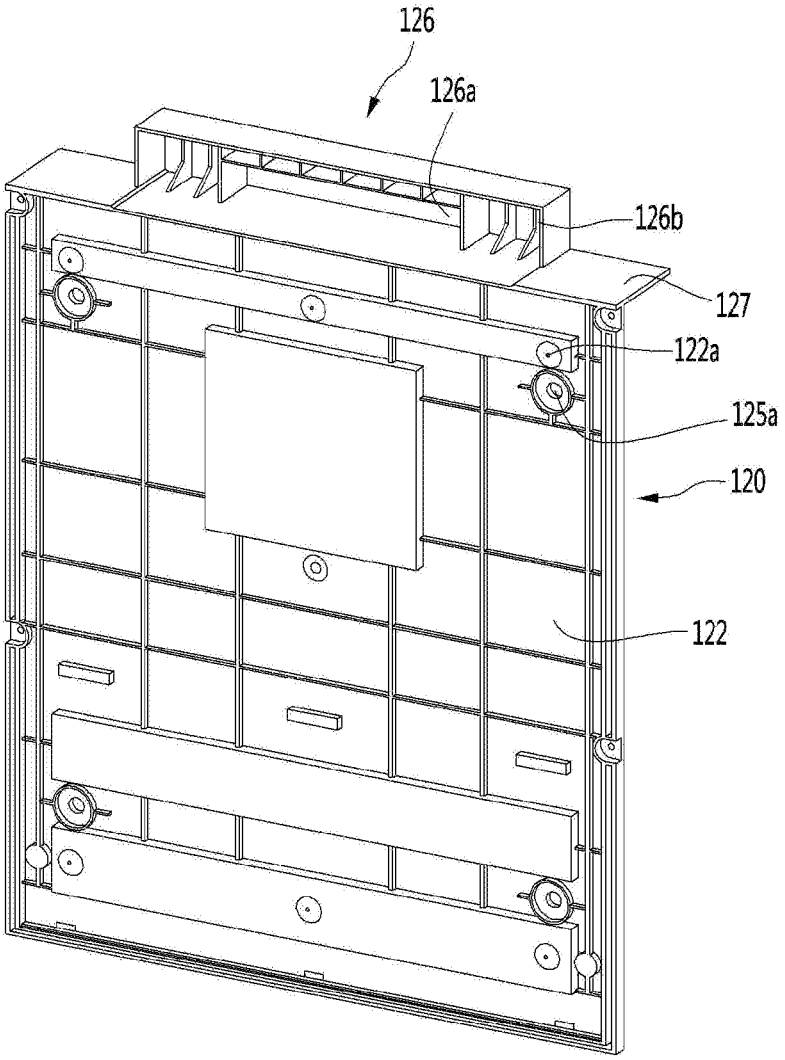
Figure 7:
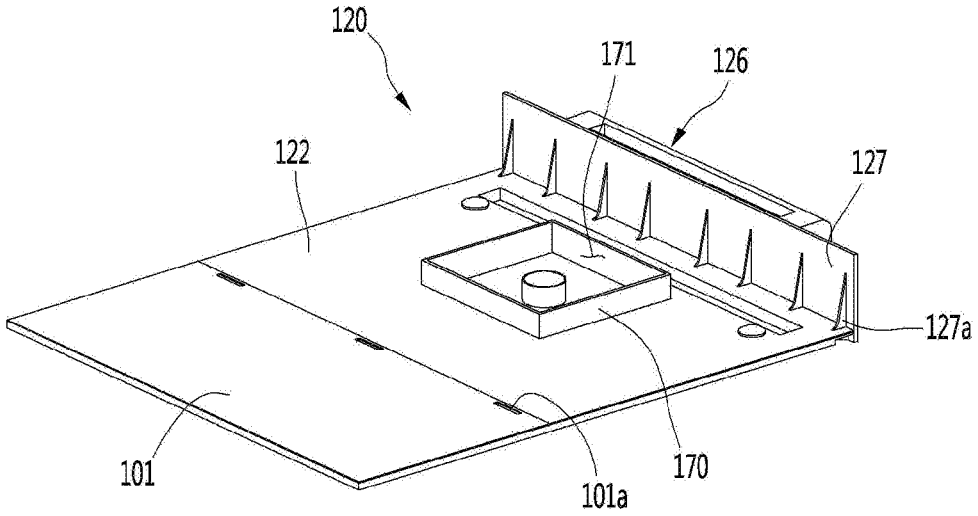
FIG. 7 is a view illustrating a state where a base panel is coupled to the base of FIG. 5.

FIGS. 5 and 6 are a perspective view illuminating the base according to an embodiment of the present disclosure, FIG. 7 is a view illustrating a state where a base panel is coupled to the base of FIG. 5, and FIG. 8 is a view illustrating a state where a shield member is positioned in a heat dissipation path.

Referring to FIGS. 5 to 8, the base 120 of the present embodiment may be, for example, an injection molded material made of plastic. The base 120 may include a bottom plate 122.

Although not limited, the front and rear lengths of the bottom plate 122 may be the same as or similar to the front and rear lengths of the respective side panels 102 and 103. Therefore, the bottom plate 122 may form an outer appearance of the bottom surface of the refrigerator 1.

The base 120 may be coupled to the case supporter 130 by, for example, a bolt. A bolt fastening hole 122*a* for fastening the bolt may be formed in the bottom plate 122.

The bottom plate 122 may be provided with one or more forming units 124 for strength reinforcement. Although not limited, the plurality of forming units 124 may be formed to be spaced apart in the front and rear direction.

An anti-slip unit 125 may be coupled to the bottom plate 122.

The anti-slip unit 125 is placed on the bottom surface to prevent the refrigerator 1 from slipping on the bottom surface. The anti-slip unit 125 may be formed of a rubber material as an example.

A coupling hole 125*a* may be formed in the base 120 to couple the non-slip unit 125.

The base 120 may further include a support rib 127 for supporting the rear panel 160.

The support rib 127 may extend upward from the rear end portion of the bottom plate 122. The front surface of the support rib 127 may be provided with a connecting rib 127*a* for connecting the upper surface of the support rib 127 and the bottom plate 122.

The support rib 127 may be prevented from being deformed with respect to the bottom plate 122 by the connecting rib 127*a*.

Although not limited, the plurality of connecting ribs 127*a* may be spaced apart from each other in the horizontal direction to connect the support ribs 127 and the bottom plate 122.

The rear surface of the support rib 127 may be provided with a handle 126 for the user to hold. The handle 126 may protrude from the rear surface of the support rib 127.

The handle 126 may be gripped when the user wishes to carry the refrigerator 1. As the handle 126 is provided on the support rib 127, the handle 126 is not visible from the outside while the refrigerator 1 is installed.

The handle 126 may form a space 126*a* for the user's hand to be located.

Although not limited, the handle 126 may be formed in the form of "⊏".

The handle 126 allows the refrigerator 1 to be spaced apart from the wall when the refrigerator 1 is positioned around the wall. This is to form a space between the refrigerator 1 and the wall so that air can smoothly flow into the inside of the refrigerator 1.

A plurality of reinforcing ribs 126*b* may be provided inside the handle 126 to improve strength.

The base 120 may further include a water collecting unit 170 for storing condensed water falling downward. The water collecting unit 170 extends upward from the bottom plate 122 to form a condensed water storage space 171.

Meanwhile, referring to FIG. 8, the lengths of the doors 20 in the vertical direction are shorter than the lengths of the side panels 102 and 103 in the vertical direction.

The upper surface of the door 20 may be positioned at the same height as the upper end portion 102*b* of each of the side panels 102 and 103.

Accordingly, the door 20 is positioned higher than the base 120 in a state where the door 20 is closed, and a portion of the base 120 is exposed to the outside.

In other words, as the door 20 is spaced apart from the base 120, an outlet 593 of the heat dissipation flow path 590 may be formed between the door 220 and the base 120.

In the present disclosure, since the side panels 102 and 103 are formed of a metal material, respectively, while the base 120 is formed of a plastic material, the same texture of material is decreased.

Therefore, the base panel 101 having the same texture of material as each of side panels 102 and 103 may be attached to the front end portion of the upper surface of the base 120.

The lengths of the base panel 101 in the front and rear direction are shorter than the lengths of side panels 102 and 103 in the front and rear direction, respectively.

Alternatively, the base panel 101 of the same material as the side panels 102 and 103 may be attached to the upper side of the base 120.

The base panel 101 may be attached to the base 120 by an adhesive or double-sided tape, for example.

The base panel 101 may cover a portion of the forming unit 124 formed on the base 120.

The base panel 101 may be disposed to overlap the door 20 in the vertical direction.

The heat dissipation flow path 590 may be provided with a shielding member 40 for preventing foreign matter from entering the heat dissipation flow path 590 through the outlet 593 of the heat dissipation flow path 590.

The shielding member 40 may be disposed at a position spaced inwardly from the outlet 593 of the heat dissipation flow path 590. This is to allow the light irradiated from the illumination unit to be described later to be irradiated to the base panel 101 so that the user can see the light irradiated to the base panel 101.

The base panel 101 may be provided with a slot 101*a* through which a portion of the shielding member 40 penetrates, and the base 120 may be formed with a fixing portion 124*a* which receives a portion of the shielding member penetrating the slot 101*a*. The fixing portion 124*a* may be a groove or a hole.

Although not limited, the base panel 101 may have a plurality of slots 101*a* spaced apart in a left and right direction, and the base 120 may have a plurality of fixing portions 124*a* spaced apart in the left and right direction. When the base panel 101 is attached to the base 120, the slot 101*a* may be aligned with the fixing portion 124*a*.

As another example, the rear end portion of the base panel 101 may be located in front of the fixing portion 124*a*. In this case, a slot may not be formed in the base panel 101.

Meanwhile, the refrigerator 1 may further include a sensing unit 80. For example, the sensing unit 80 may be installed in the case supporter 130.

The sensing unit 80 is a component for detecting a user located in front of the refrigerator 1.

The sensing unit 80 will be described later with reference to the drawings.

Figure 9:
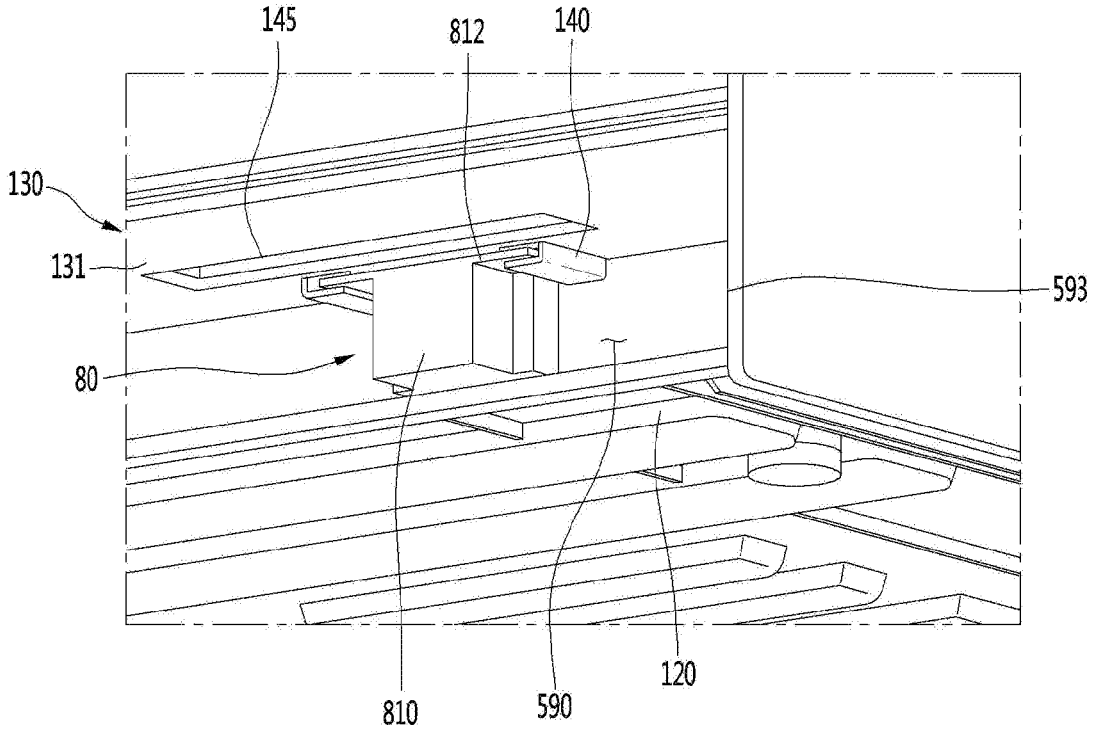
FIG. 9 is a view illustrating a state where a sensing unit is installed in a case supporter according to an embodiment of the present disclosure.
Figure 10:
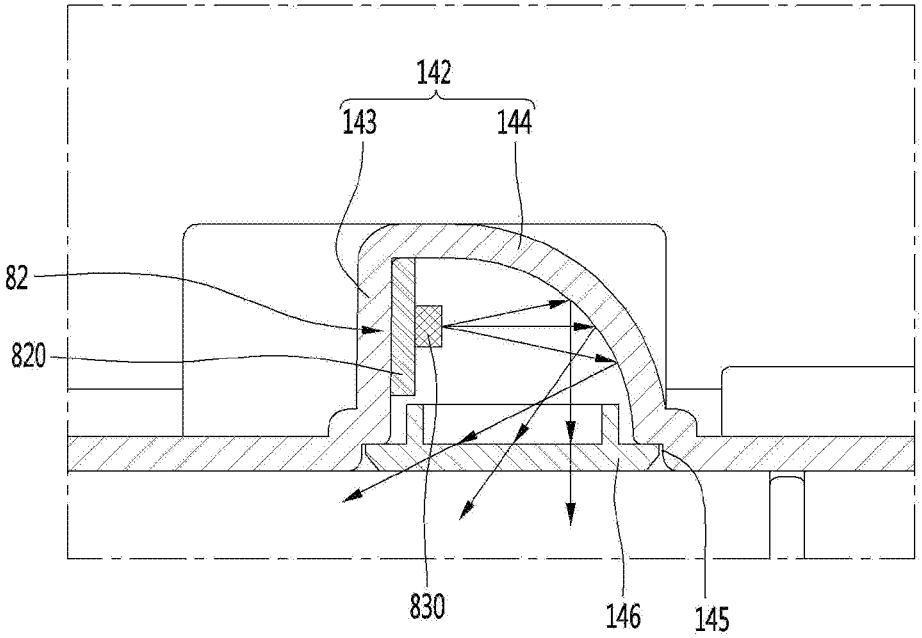
FIG. 10 is a sectional view illustrating an illumination unit according to an embodiment of the present disclosure.
Figure 11:
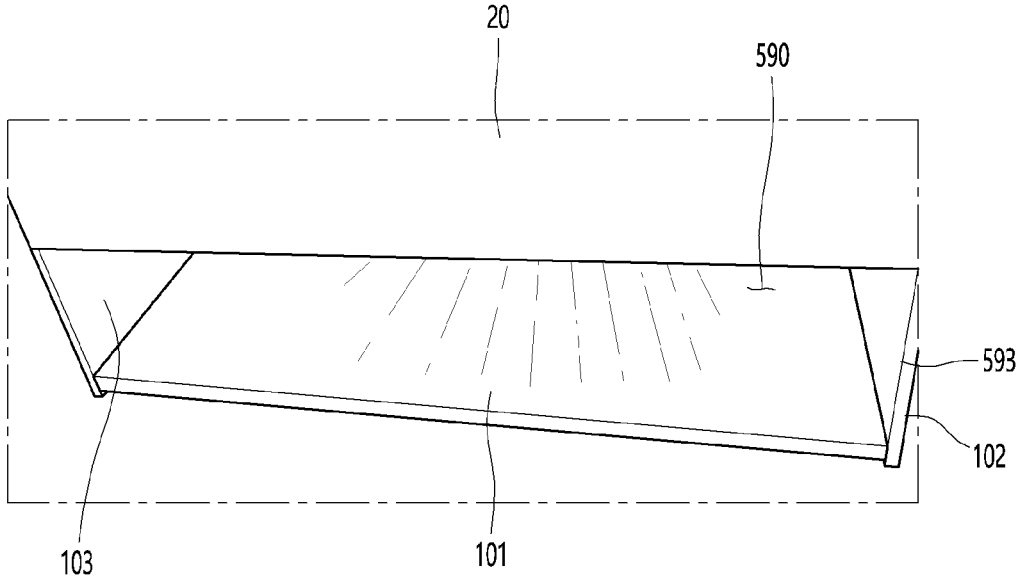
FIG. 11 is a view illustrating a state where light is irradiated to the base panel in the illumination unit.

FIG. 9 is a view illustrating a state where a sensing unit is installed in a case supporter according to an embodiment of the present disclosure, FIG. 10 is a sectional view illustrating an illumination unit according to an embodiment of the present disclosure, and FIG. 11 is a view illustrating a state where light is irradiated to the base panel in the illumination unit.

Referring to FIGS. 9 to 11, the case supporter 130 may include a supporter plate 131. The supporter plate 131 is positioned above the base 120 and spaced apart from the base 120.

A sensing unit installation portion 140 for installing the sensing unit 80 may be provided below the supporter plate 131.

For example, the sensing unit 80 may be located at a point that bisects the supporter plate 131 in the left and right direction or a point adjacent thereto.

The sensing unit 80 may include a sensor and a sensor housing 810 for protecting the sensor. The sensor may be, for example, a PSD sensor (Position Sensitive Detector).

In this embodiment, since the sensing unit installation portion 140 is provided below the supporter plate 131, the sensing unit 80 may be installed in the sensing unit installation portion 140 after the filling of the foam liquid is completed. Therefore, the phenomenon in which the sensing unit 80 is damaged by the high temperature foaming liquid in the foaming process can be prevented.

For example, a pair of sensing unit installation portions 140 are disposed spaced apart in the left and right direction, and the sensor housing 810 can be slidingly coupled to the sensing unit installation portion 140 in front of the sensing unit installation portion 140. To this end, both sides of the sensor housing 810 may be provided with an extension portion 812 for coupling with the sensing unit installation portion 140.

In a state where the sensing unit 80 is installed in the case supporter 130, the sensing unit 80 protrudes into the heat dissipation flow path 592.

In addition, the sensing unit 80 may be exposed to the outside by a space between the case supporter 130 and the base 120. However, the sensing unit 80 may be disposed at a position spaced rearward from the outlet 593 of the heat dissipation flow path 590 by the predetermined distance so as to prevent the sensing unit 80 from being damaged by an external impact.

In other words, the sensing unit 80 may be located behind the door 20 while the door 20 is closed in the storage chamber 111.

In a state where the sensing unit 80 is installed in the case supporter 130, the sensing unit 80 may be disposed at a position spaced apart from the base 120 by a predetermined height.

Therefore, even when liquid or foreign matters flows into the space between the case supporter 130 and the base 120, the liquid or foreign matters may be prevented from coming into contact with the sensing unit 80.

The refrigerator 1 of the present embodiment may further include an illumination unit 82 that may operate based on a sensing result of the sensing unit 80.

The illumination unit 82 may be installed in the case supporter 130.

For example, the case supporter 130 may be provided with an illumination unit installation portion 142 for installing the illumination unit 82.

The illumination unit installation portion 142 may be formed, for example, as the lower surface of the supporter plate 131 is recessed upward. In addition, an inlet 145 for installing the illumination unit 82 may be formed in the case supporter 130.

The illumination unit installation portion 142 may include an installation surface 143 extending upward from the supporter plate 131 and a reflection surface 144 inclined downward from the installation surface 143 to the rear of the supporter plate 131.

The reflection surface 144 may extend to be rounded downward from the upper end of the installation surface 143 toward the rear.

Accordingly, the installation surface 143 and the reflection surface 144 form a space for receiving the illumination unit 82.

The illumination unit 82 may include a PCB 820 and one or more light emitting units 830 installed on the PC 820.

For example, the PCB 820 may be installed on the installation surface 143 in an upright state, and the one or more light emitting units 830 may be installed on the installation surface 143 to face the reflection surface 144.

The one or more light emitting units 830 may irradiate light in a direction away from the door 20.

The case supporter 130 may be coupled to a transmissive portion 146 through which the light irradiated from the light emitting unit 830 is penetrated. The transmissive portion 146 is located under the illumination unit installation portion 142. The transmissive portion 146 may cover the inlet 145.

The light transmitted through the transmissive portion 146 is irradiated to the heat dissipation flow path 590 in the space between the supporter plate 131 and the base 120. The light transmitted through the transmissive portion 146 is irradiated onto the upper surface of the base panel 101 as an example.

The light irradiated onto the upper surface of the base panel 101 is reflected, and the user can confirm that the light is irradiated to the heat dissipation flow path 590 through the outlet 593 of the heat dissipation flow path 50.

Although not limited, the sensing unit 80 may be located behind the transmissive portion 146 so that the sensing unit 80 does not act as an obstacle in the path of light. In other words, the transmissive portion 146 may be located closer to the outlet 193 of the heat dissipation flow path 590 than the sensing unit 80.

In addition, the transmissive portion 146 (or the inlet 145) may be disposed to overlap the base panel 101 in the vertical direction so that the light passing through the transmissive portion 146 is irradiated to the base panel 101.

In addition, the sensing unit 80 may be disposed to be spaced apart from the base panel 101 and overlap the base panel 101 in the vertical direction.

Figure 12:
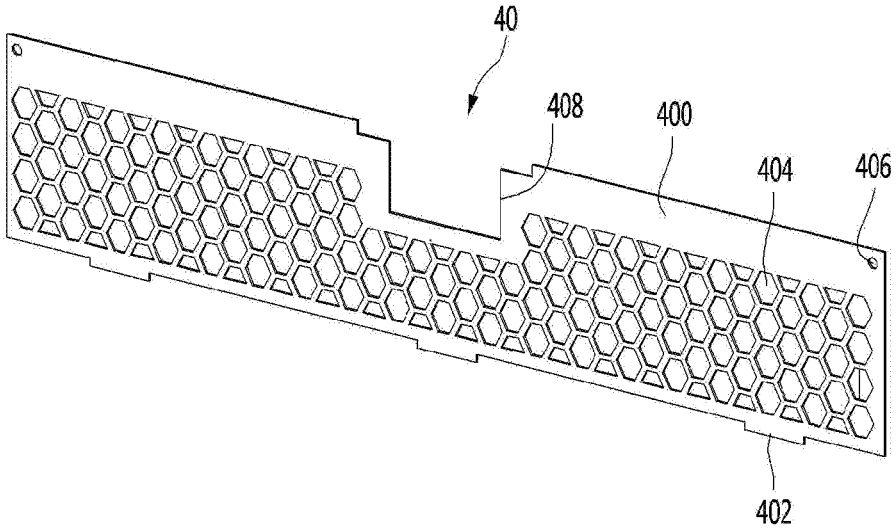
FIG. 12 is a perspective view of a shield member according to an embodiment of the present disclosure.
Figure 13:
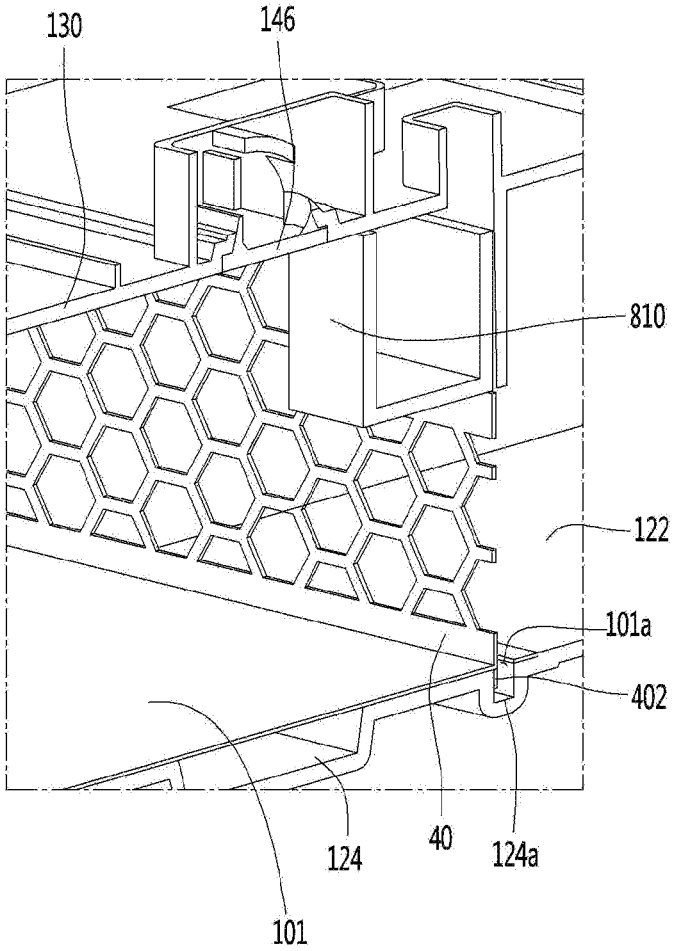
FIG. 13 is a view illustrating a state where the shielding member is disposed in the heat dissipation flow path according to an embodiment of the present disclosure.

FIG. 12 is a perspective view of a shield member according to an embodiment of the present disclosure, and FIG. 13 is a view illustrating a state where the shielding member is disposed in the heat dissipation flow path according to an embodiment of the present disclosure.

Referring to FIGS. 12 and 13, the shielding member 40 may include a shielding body 400. The shielding body 40 may be formed in a thin plate shape and may include a plurality of holes 404 that provide passages of air. The plurality of holes 404 allow air to pass through, and foreign matters larger than a predetermined size do not pass through.

FIG. 12 illustrates that the hole 404 is formed in a hexagonal shape, but is not limited thereto, and may be formed in various shapes such as a circular shape and a polygonal shape.

A fixing portion 402 may be provided below the shielding body 400. The fixing portion 402 may extend downward from the lower end of the shielding body 400.

Although not limited, the plurality of fixing portions 402 may be spaced apart from the shielding body 400 in the horizontal direction.

The fixing portion 400 may be received in the receiving portion 124*a* of the base 120 through the slot 101*a* of the base panel 101.

The shielding body 400 may be provided with a fastening hole 406 for fastening with the base supporter 130. The fastening member may be fastened to the base supporter 130 by passing through the fastening hole 406.

The shielding member 40 is located in the heat dissipation flow path 590 as described above, in order to prevent the light irradiated from the illumination unit 82 from being blocked by the heat dissipation flow path 590, the shielding member 40 may be located behind the transmissive portion 146.

In other words, the shielding member 40 may be located farther from the outlet 593 of the heat dissipation flow path 590 than the transmissive portion 146.

At this time, since the shielding member 40 is located behind the transmissive portion 146, the shielding member 40 is located behind the front of the sensing unit 80 so that the shielding member 40 does not block the front of the sensing unit 80.

Therefore, the shielding body 400 may include an opening 408 for preventing interference with the sensing unit 80 while the shielding body 400 is drawn into the heat dissipation flow path 590. For example, the opening 408 may be located at an upper center portion of the shielding body 400.

The height of the shielding body 400 except for the fixing portion 402 may be the same as or slightly smaller than the height of the heat dissipation flow path 590 disposed between the base plate 131 and the base panel 101. In addition, the height of the shielding body 400 including the fixing portion 402 may be greater than the height of the heat dissipation flow path 590 positioned between the base plate 131 and the base panel 101.

Therefore, in order to position the shield member 40 in the heat dissipation flow path 590, the shield member 40 is drawn into the heat dissipation flow path 590 in an inclined state. In addition, the sensing unit 80 passes through the opening 408.

Next, the fixing portion 402 is received in the receiving portion 124*a* of the base 120 through the slot 101*a* of the base panel 101. The shielding member 40 may be erected perpendicular to the bottom surface while receiving the fixing portion 402 in the receiving portion 124*a* of the base 120. Finally, when the fastening member is fastened to the fastening hole 406, the installation of the shielding member 40 may be completed.

Figure 14:
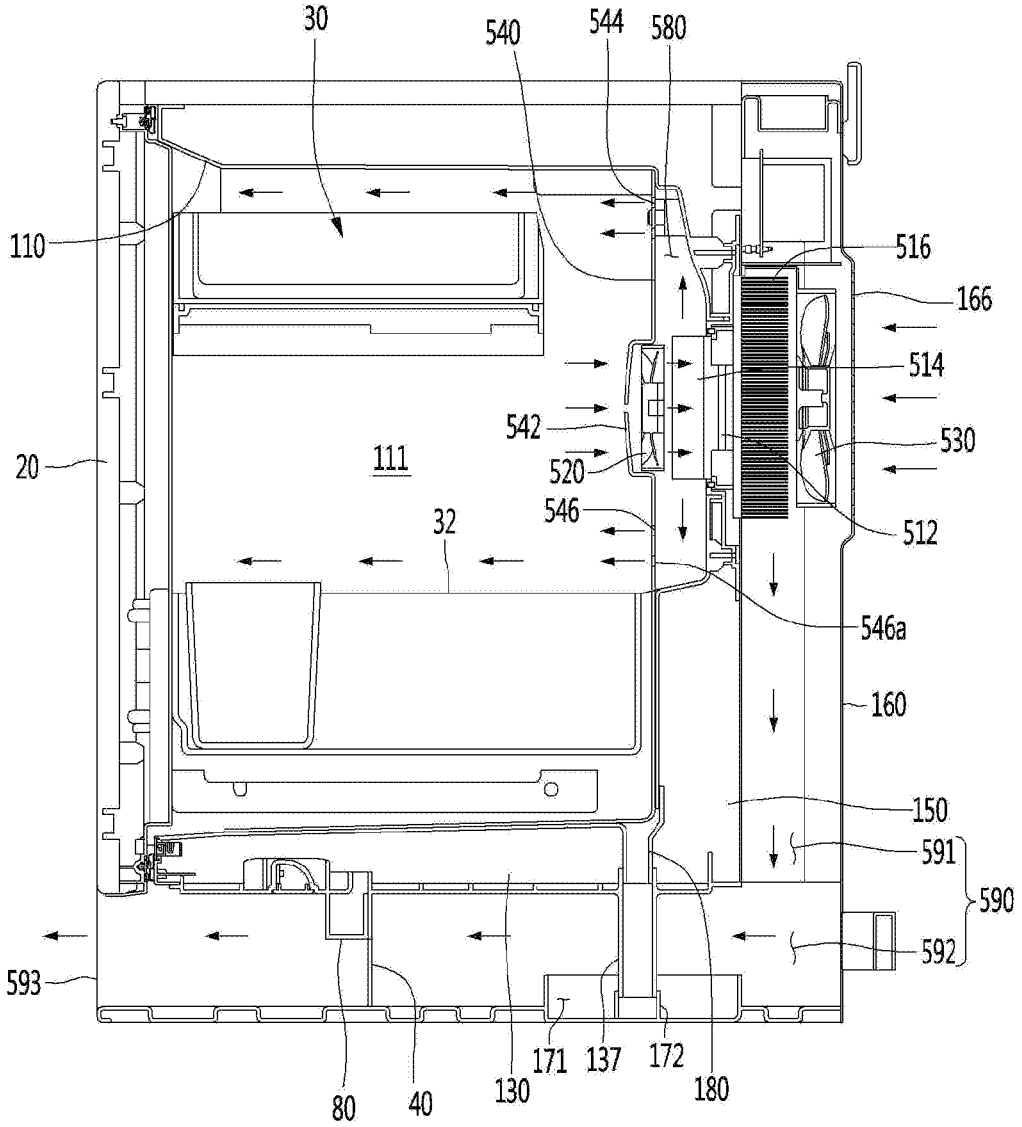
FIG. 14 is a vertical sectional view of a refrigerator according to an embodiment of the present disclosure.

FIG. 14 is a vertical sectional view of a refrigerator according to an embodiment of the present disclosure.

Referring to FIG. 14, the cooling device 50 may include a thermoelectric module. The thermoelectric module may include a thermoelectric element 512.

The thermoelectric module may maintain the temperature of the storage chamber 111 to be low by utilizing a Peltier effect. Since the thermoelectric module itself is a well-known technology, details of driving principles will be omitted.

The thermoelectric module may further include a cooling sink 514 and a heat sink 516.

The thermoelectric element 512 may include a low temperature portion and a high temperature portion, and the low temperature portion and the high temperature portion may be determined according to a direction of a voltage applied to the thermoelectric element 512. The low temperature portion of the thermoelectric element 512 may be disposed closer to the inner case 110 than the high temperature portion.

The low temperature portion may be in contact with the cooling sink 514, and the high temperature portion may be in contact with the heat sink 516. The cooling sink 514 cools the storage chamber 111, and heat dissipation may occur in the heat sink 516.

The cooling device 50 may further include a cooling fan 520 for flowing air from the storage chamber 111 to the cooling sink 514, and a heat radiating fan 530 for flowing external air to the heat sink 516.

The cooling fan 520 may be disposed in front of the cooling sink 514, and the heat radiating fan 530 may be disposed at the rear of the heat sink 516.

The cooling fan 520 may be disposed to face the cooling sink 514, and the heat radiating fan 530 may be disposed to face the heat sink 516.

The cooling fan 520 may be disposed in the inner case 110. The cooling fan 520 may be covered by the fan cover 540.

The fan cover 540 may be coupled to the rear surface of the inner case 110 in a state of being disposed inside the inner case 110. The fan cover 540 may partition the storage chamber 111 and the cooling flow path 580.

In other words, the storage chamber 111 may be located in front of the fan cover 540, and the cooling flow path 580 may be located behind the fan cover 540.

The cooling fan 520 may flow air from the storage chamber 111 into the cooling flow path 580. In addition, the cooling sink 514 may be located in the cooling flow path 580.

The low-temperature air heat-exchanged with the cooling sink 514 disposed in the cooling flow path 580 may flow back into the storage chamber 111 to maintain a temperature in the storage chamber 111 to be low.

Inner suction holes 542 and inner discharge holes 544 and 546 may be formed in the fan cover 540.

The number, size, and shape of the inner suction hole 542 and the inner discharge hole 544 and 546 may vary as necessary.

The inner discharge holes 544 and 546 may include an upper discharge hole 544 and a lower discharge hole 546. The upper discharge hole 544 may be located above the inner suction hole 542, and the lower discharge hole 546 may be located below the inner suction hole 542. This configuration has the advantage that the temperature distribution of the storage chamber 111 can be uniform.

The cooling fan 520 may be disposed to face the inner suction hole 542. When the cooling fan 520 is driven, air in the storage chamber 111 may be sucked into the cooling flow path 580 through the inner suction hole 542 to be heat-exchanged with the cooling sink 514 and cooled.

The cooled air may be discharged to the storage chamber 111 through the inner discharge holes 544 and 546, whereby the temperature of the storage chamber 111 may be maintained at a low temperature.

In more detail, a portion of the air cooled in the cooling sink 514 may be directed upward to be discharged to the storage chamber 111 through the upper discharge hole 544, and another portion of the air cooled in the cooling sink 514 may be downwardly guided to the lower side and thus may be discharged to the storage chamber 111 through the lower discharge hole 546.

Condensed water may be generated on the surface of the cooling sink 514 by moisture included in the air while the air of the storage chamber 111 exchanges heat with the cooling sink 514 of the thermoelectric element 512.

The generated condensed water may flow down to the bottom of the inner case 110. In order to discharge the condensed water flowing to the bottom of the inner case 110 to the outside, a condensed water discharge tube 180 may be provided at the bottom of the inner case 110.

The condensed water discharge tube 180 may be integrally formed with the inner case 110 or manufactured separately, and may be coupled to the bottom of the inner case 110.

The case supporter 130 may be provided with a condensed water guide tube 137. The condensed water discharge tube 180 may be connected to an upper side of the condensed water guide tube 137. For example, the condensed water discharge tube 180 may be inserted above the condensed water guide tube 137.

Therefore, the condensed water discharged from the inner case 110 to the condensed water discharge tube 180 flows downward along the condensed water guide tube 137.

The base 120 is provided with a water collecting unit 170 in which condensed water is stored. A portion of the condensed water guide tube 137 is located in the water collecting space 171 in the water collecting unit 170.

The bottom of the water collecting unit 170 may be provided with a tube cover rib 172 surrounding the lower end portion of the condensed water guide tube 137 and the tube cover rib 172 protrudes upward from the bottom of the water collecting unit 170. The height of the tube cover rib 172 is formed to be lower than the height of the water collecting unit 170.

The refrigerator 1 may further include a heat dissipation flow path 590.

The outside air may be guided to the heat dissipation flow path 590 by driving the heat dissipation fan 530, and may be heated and by being heat-exchanged with the heat sink 516.

The heat dissipation flow path 590 may be located outside the inner case 110.

The heat dissipation flow path 590 is a rear heat dissipation flow path 591 (first heat dissipation flow path) located behind the inner case 110, and a lower heat dissipation flow path 592 (second heat dissipation flow path) located under the inner case 110.

The rear heat dissipation flow path 591 may be located between the middle plate 150 and the rear panel 160. For example, the rear heat dissipation path 591 may be formed by the rear plate 152 of the middle plate 150 and the rear panel 160.

The heat sink 516 may be disposed in the rear heat dissipation flow path 591. The heat sink 516 may be disposed to face the heat dissipation fan 530.

The rear heat dissipation flow path 591 may communicate with an outside air suction hole 166 provided in the rear panel 160. The rear heat dissipation flow path 591 may guide the air sucked into the outside air suction hole 166 to the lower heat dissipation flow path 592.

The lower heat dissipation flow path 592 may be located between the case supporter 130 and the base 120. The lower heat dissipation flow path 592 may communicate with the rear heat dissipation flow path 591.

The lower heat dissipation flow path 592 may guide the air flowing from the rear heat dissipation flow path 591 to the outlet 593 below the door 20.

In addition, the sensing unit 80 and the shielding member 40 may be positioned in the lower heat radiation flow path 592.

On the other hand, as described above, the base 120 is provided with a handle 126, and the handle 126 is located at the rearmost side of the refrigerator 1 as a whole. In other words, the handle protrudes from the rear surface of the refrigerator 1 to the rear of the handle 126. Therefore, when the refrigerator 1 is disposed adjacent to the wall surface, the wall surface and the rear surface of the refrigerator 1 (at least a portion where the outside air suction hole 166 is formed) are separated from the wall by the handle 126 and space is allowed for air to flow.

Figure 15:
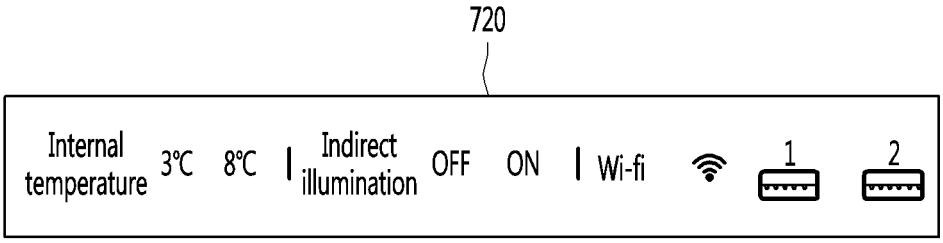
FIG. 15 is a view illustrating information displayed on a display unit according to an exemplary embodiment of the present disclosure.

FIG. 15 is a view illustrating information displayed on a display unit according to an exemplary embodiment of the present disclosure, and FIG. 16 is a view for explaining a method of operating a light emitting unit according to a selected illumination mode.

Referring to FIGS. 15 and 16, an internal temperature of the storage chamber 111 may be displayed on the display unit 720. The internal temperature may be set to be divided into a plurality of temperatures, and the light emitting unit corresponding to the temperature selected by the user may be displayed in an on state.

In addition, the display unit 720 may display a mode for the operation of the illumination unit 82.

The mode may be divided into a continuous on mode, an automatic mode, and an off mode. The off mode is a mode in which the illumination unit 82 is maintained in an off state, and the continuous on mode is a mode in which the illumination unit 82 is maintained in an on state.

The automatic mode is a mode that is turned off after the illumination unit 82 is turned on for a predetermined time when the sensing unit 80 detects the proximity of the user.

The display unit 720 may display, for example, items of indirect lighting, off, and on.

Although not limited, the off and the on may be a command input unit, and the indirect illumination may be an information output unit.

For example, when the user selects the on once, the automatic mode may be selected so that the light emitting unit for irradiating light with the indirect illumination may be turned on. At this time, the light emitting unit may be turned off after blinking a plurality of times.

If the user selects the on again, the continuous on mode may be selected.

In this case, the light emitting unit may be kept in an on state.

On the other hand, when the user selects the off, the off mode may be selected, and the light emitting unit may be turned off.

As another example, a plurality of light emitting units displaying a plurality of modes may be provided, and the light emitting units corresponding to the selected mode may be turned on.

The refrigerator 1 according to the present embodiment may further include a communication module (not illustrated) capable of communicating with an external device.

The communication module may be, for example, a Wi-Fi communication module, but it is clear that the type of the communication module is not limited in this embodiment.

The display unit 720 may display the communication strength of the communication module.

The display unit 720 may further display whether a charging cable is connected to the charging port 722.

The invention claimed is:

1. A refrigerator comprising:

an inner case that defines a storage chamber;

an outer case that surrounds the inner case and that defines an air suction hole, the outer case comprising a plurality of side panels that cover sides of the inner case and that are made of a metal material;

a door configured to open and close at least a portion of the storage chamber;

a case supporter configured to support the inner case;

a base configured to support a lower side of the case supporter, at least a portion of the base being configured to be spaced apart from a lower side of the door and the case supporter;

a rear heat dissipation flow path defined between the inner case and the outer case and configured to communicate with the air suction hole of the outer case;

a lower heat dissipation flow path defined between the case supporter and the base and configured to communicate with the rear heat dissipation flow path; and a base panel that is attached to an upper surface of the base adjacent to the door and that defines at least a portion of the lower heat dissipation flow path, the base panel being made of the metal material or having a metal texture.

2. The refrigerator of claim 1, wherein the base panel is spaced apart from a lower surface of the door and is disposed to overlap the door in a vertical direction.

3. The refrigerator of claim 1, further comprising:

a cooling device configured to cool the storage chamber, the cooling device including a thermoelectric element, a cooling sink, and a heat sink, wherein a spaced space between the base and the case supporter defines the lower heat dissipation flow path for discharging air having exchanged heat with the heat sink.

4. The refrigerator of claim 3, further comprising a shielding member that covers the lower heat dissipation flow path and that defines a plurality of holes through which air passes.

5. The refrigerator of claim 4, wherein an outlet of the lower heat dissipation flow path is disposed between a lower end of the door and the base, and wherein the shielding member is disposed at a position spaced rearward from the outlet of the lower heat dissipation flow path.

6. The refrigerator of claim 5, wherein the shielding member includes:

a shielding body including the plurality of holes; and a fixing portion extending from the shielding body, and wherein the base comprises a receiving portion that receives the fixing portion.

7. The refrigerator of claim 6, wherein the base panel includes a slot through which the fixing portion passes.

8. The refrigerator of claim 6, wherein the shielding body defines a fastening hole configured to receive a fastening member fastened to the case supporter.

9. The refrigerator of claim 5, further comprising:

a sensing unit installed in the case supporter; and an illumination unit configured to irradiate light to the lower heat dissipation flow path, wherein the sensing unit and the illumination unit are located closer to the outlet of the lower heat dissipation flow path than the shield member.

10. The refrigerator of claim 9, wherein the sensing unit protrudes from the case supporter toward the lower heat dissipation flow path, and wherein the shielding member defines an opening through which the sensing unit passes.

11. The refrigerator of claim 9, wherein the case supporter includes:

an illumination unit installation portion that supports the illumination unit and that defines an inlet configured to receive the illumination unit; and a transmissive portion that covers the inlet, and wherein the transmissive portion is located closer to the outlet of the lower heat dissipation flow path than the sensing unit.

12. The refrigerator of claim 11, wherein the transmissive portion is spaced apart from the base panel and is disposed to overlap the base panel in a vertical direction.

13. The refrigerator of claim 11, wherein the illumination unit installation portion includes:

an installation surface that extends in a vertical direction, and a reflection surface that extends rearward from an upper end portion of the installation surface and that is inclined with respect to the installation surface, wherein the illumination unit includes:

a printed circuit board (PCB) installed on the installation surface, and one or more light emitters installed on the PCB, and wherein the one or more light emitters are disposed to face the reflective surface.

14. The refrigerator of claim 9, wherein the sensing unit is spaced apart from the base panel and is disposed to overlap the base panel in a vertical direction.

15. The refrigerator of claim 1, wherein the base comprises a handle disposed at a rear surface of the base and configured to be held by a user, and wherein the handle defines a rearmost position of the refrigerator.

16. A refrigerator comprising:

an inner case that defines a storage chamber;

an outer case that surrounds the inner case;

a door configured to open and close at least a portion of the storage chamber;

a case supporter configured to support the inner case;

a base configured to support a lower side of the case supporter, at least a portion of the base being spaced apart from a lower side of the door and the case supporter to thereby define a heat dissipation flow path;

a sensing unit installed in the case supporter;

an illumination unit configured to irradiate light to the heat dissipation flow path; and a shielding member that covers the heat dissipation flow path, wherein the sensing unit and the illumination unit are located closer to an outlet of the heat dissipation flow path than the shield member.

17. The refrigerator of claim 16, wherein the sensing unit protrudes from the case supporter toward the heat dissipation flow path, and wherein the shielding member defines an opening through which the sensing unit passes.

18. The refrigerator of claim 16, wherein the case supporter includes:

an illumination unit installation portion that supports the illumination unit and that defines an inlet configured to receive the illumination unit; and a transmissive portion that covers the inlet, and wherein the transmissive portion is located closer to the outlet of the heat dissipation flow path than the sensing unit.

19. The refrigerator of claim 18, wherein the illumination unit installation portion includes:

an installation surface that extends in a vertical direction; and a reflection surface that extends rearward from an upper end portion of the installation surface and that is inclined with respect to the installation surface, wherein the illumination unit includes:

a printed circuit board (PCB) installed on the installation surface, and one or more light emitters installed on the PCB, and wherein the one or more light emitters are disposed to face the reflective surface.

20. The refrigerator of claim 16, wherein the shielding member includes:

a shielding body including a plurality of holes; and a fixing portion extending from the shielding body, and wherein the base defines a receiving portion that receives the fixing portion.

* * * * *